United States Patent [19]

Trocciola

[11] Patent Number: 4,566,957

[45] Date of Patent: Jan. 28, 1986

[54] USE OF GAS DEPOLARIZED ANODES FOR THE ELECTROCHEMICAL PRODUCTION OF ADIPONITRILE

[75] Inventor: John C. Trocciola, Glastonbury, Conn.

[73] Assignee: United Technologies Corporation, Hartford, Conn.

[21] Appl. No.: 680,405

[22] Filed: Dec. 10, 1984

[51] Int. Cl.[4] ..... C25B 3/00

[52] U.S. Cl. ..... 204/73 A

[58] Field of Search ..... 204/73 R, 73 A, 284

[56] References Cited

U.S. PATENT DOCUMENTS

| | | | |
|---|---|---|---|
| 3,661,739 | 5/1972 | Tomilov et al. | 204/73 A |
| 3,682,793 | 8/1972 | Seko et al. | 204/73 A |
| 4,132,619 | 1/1979 | Klein et al. | 204/290 R |

FOREIGN PATENT DOCUMENTS

| | | |
|---|---|---|
| 813877 | 5/1969 | Canada . |
| 1251899 | 11/1971 | United Kingdom . |

*Primary Examiner*—John F. Niebling

*Attorney, Agent, or Firm*—A. Dean Olson

[57] ABSTRACT

Gas depolarized anodes used in the electrohydrodimerization of acrylonitrile to adiponitrile result in anode voltage requirements of less than about 400 millivolts at 100 milliamperes per square centimeter of electrode area. Typically, oxygen evolving anodes characterized by high theoretical voltages and high overvoltages are utilized in the hydrodimerization of acrylonitrile to adiponitrile. Gas depolarized anodes requiring substantially reduced voltages perform well in the conventional electrochemical adiponitrile production environment.

5 Claims, 1 Drawing Figure

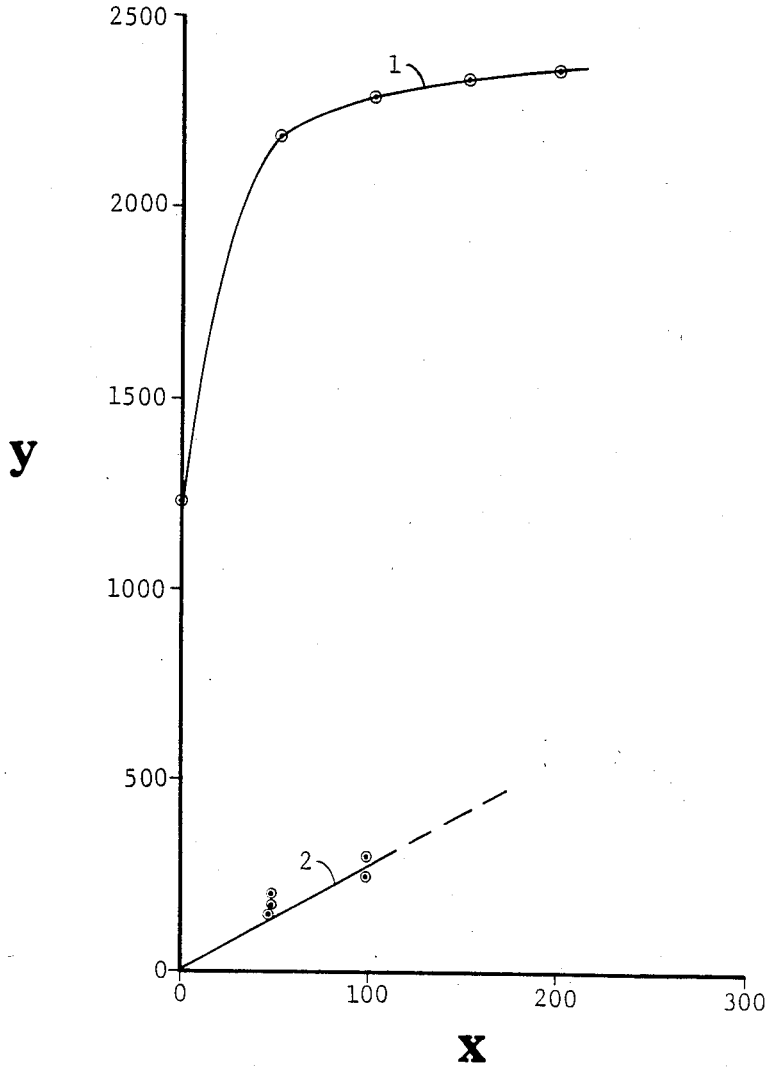
2500
2000
1500
1000
500
0
y
1
2
0
100
200
300
x

USE OF GAS DEPOLARIZED ANODES FOR THE ELECTROCHEMICAL PRODUCTION OF ADIPONITRILE

DESCRIPTION

1. Technical Field

The field of art to which this disclosure pertains is electrolysis processes for synthesizing organic compounds particularly methods of producing adiponitrile.

2. Background Art

Adiponitrile is utilized extensively in the manufacture of Nylon 66-type synthetic fibers, and in several other organic synthesis processes.

One of the simplest known methods for the preparation of adiponitrile involves the hydrodimerization of acrylonitrile. In the electrolysis process, adiponitrile is produced at the cathode and oxygen is evolved at the anode. Empirically this can be illustrated as:

$$2H_2CCHCN + 2H_2O + 2e^- \longrightarrow NC(CH_2)_4CN + 2OH^-$$

$$2OH^- \longrightarrow \tfrac{1}{2}O_2 + H_2O + 2e^-$$

Typically the anode reaction, oxygen evolution, is done on a lead anode. This reaction is characterized by high overvoltages which can be 0.8 volt or more. In addition the theoretical voltage for oxygen evolution is 1.23 volts resulting in a total voltage requirement in excess of 2 volts (E) to drive the reaction at the anode. These voltages result in significant cell power consumption (IE).

Accordingly, there is a constant search in the art for processes that electrohydrodimerize acrylonitrile to produce adiponitrile that result in reduced cell power consumption.

DISCLOSURE OF INVENTION

This discovery is directed at a low energy method of hydrodimerizing acrylonitrile to produce adiponitrile in an electrochemical cell. The cells contain a gas depolarized anode, a cathode, aqueous electrolyte and reductant. The electrolyte solution is maintained in contact with the cathode and the gas depolarized anode. A supply of acrylonitrile is maintained in contact with the cathode and a supply of reductant is maintained in contact with the anode. A direct electric current is passed through the system causing acrylonitrile to be hydrodimerized to adiponitrile at the cathode and a reductant to be oxidized at the anode. This process results in an anode voltage requirement of less than about 400 millivolts (mv) at 100 milliamperes per square centimeter (ma/cm$^2$) of electrode area.

This discovery provides a significant advancement to electrochemical technology, particularly the adiponitrile industry. Electrochemical processes that utilize gas depolarizing anodes for the hydrodimerization of acrylonitrile to adiponitrile require less anode voltages resulting in significant energy savings.

Other features and advantages will be apparent from the specification and claims and from the accompanying drawing which illustrates an embodiment of this invention.

BRIEF DESCRIPTION OF DRAWING

The FIGURE illustrates comparative voltages for hydrogen consuming anodes of the present invention and oxygen evolving anodes typical of the prior art.

BEST MODE FOR CARRYING OUT THE INVENTION

Generally any conductive electrode substrate compatible with the acrylonitrile electrohydrodimerization system can be used to make the anode, preferably carbon paper, stainless steel or carbon steel, or nickel substrates. It is especially preferred that a carbon paper conductive electrode substrate be used. Typical substrates are about 15 mils to about 25 mils in thickness. Substrate porosities range from as low as about 60% to as high as about 90% preferable about 80% with pore size diameters about 15–50 microns ($\mu$). Optionally, the porous substrate is wetproofed with from about 2 to about 10 milligrams per square centimeter (mg/cm$^2$) of polytetrafluoroethylene (PTFE) or fluorinated ethylene propylene.

The conductive electrode substrate supports a catalyst-binder layer typically referred to as the catalyst layer. Generally any catalyst-binder mixture that is compatible with the acrylonitrile electrohydrodimerization system can be used preferably a mixture of a fluorocarbon polymer with a molecular weight greater than $10^6$ and a noble metal catalyst. It is especially preferred that the binder is PTFE and the catalyst is platinum. Generally the mixture is about 30% to about 50% binder, preferably 40%, and about 4% to about 8% catalyst, preferably 6%. Typically, the catalyst is supported on carbon particles and are commonly referred to as catalyzed carbon. Typical catalyst layers are about 2 mils to about 5 mils in thickness, and the mean pore diameter is about 1 ($\mu$). The substrate and catalyst layer form conventional gas depolarizing anodes that can be made by methods known to those skilled in the art. Note commonly assigned U.S. Pat. Nos. 4,175,055 and 4,313,972 the disclosures of which are incorporated by reference. Briefly, as shown below, the substrate is made and the catalyst layer is applied to the substrate.

Carbon paper itself may be made, for example, by carbonizing a fiber such as nylon, rayon, coal tar, or oil tar, by heating to about 1300° F. in an inert atmosphere. The carbonized fibers are then cut to the desired length and made into paper by any one of the well known paper making process. The paper may then be graphitized by further heating. It may then be wetproofed by impregnating it with from 2–10 mg/cm$^2$ PTFE such as by dipping the graphitized carbon paper in a solution of TFE-30 TM (DuPont de Nemours, E.I., Co.) containing 26% PTFE solids. TFE-30 is an aqueous dispersion (including a surfactant) of PTFE particles of about 0.2 micron size. The impregnated carbon paper is dried at 160+10° F. for 25 minutes. It is then placed in a bath of isopropanol to leach out most of the surfactant. The leaching step is optional since the surfactant may be removed during later steps in the electrode manufacturing process. Finally, the substrate is heated to 640° F. and held at the temperature for about 20 minutes. Methods for making carbon paper substrates are also described in commonly owned U.S. Pat. No. 3,972,735 and in U.S. Pat. No 3,829,327. Carbon fiber paper can also be purchased from various manufacturers such as Union Carbide Co., Stackpole Carbon Co., and Kreha Crop.

The catalyst layer described above is then applied to the coated substrate by any suitable method such as those conventional in the art like spraying, direct filtration, and indirect filtration (filter-transfer). Preferably the layer is applied by the dry method disclosed in U.S. Pat. Nos. 4,313,972 and 4,175,055. Thus carbon powder and an aqueous PTFE dispersion are blended into an alcohol/water solution to form a co-suspension of catalyzed carbon and PTFE therein. Typically the carbon is precatalyzed, wherein a catalyst preferably platinum is disposed on the surface of the carbon particles such that the carbon is a support for the catalyst. Catalyzed carbon may be made by conventional means including that described in commonly owned U.S. Pat. No. 3,857,737 the disclosure which is incorporated by reference. The use of precatalyzed carbon is preferred because a separate catalyzing step after the carbon-hydrophobic polymer layer is applied to the substrate is thereby eliminated. The above suspension is caused to floc, such as by heating or adding a floccing agent. Floccing is the coalescence of the catalyzed carbon particles with the PTFE particles. After floccing the excess liquid is decanted and the floc is dried and pulverized to fine powder. The powder is dispersed as a cloud of particles in a chamber over the substrate and pulled onto the substrate by drawing a vacuum under the substrate. The applied powder layer is then conventionally compacted (e.g. by rolling) to ensure good particle to particle contact and the coated substrate is sintered at 590° F. for about 15 minutes.

The gas depolarized anodes described above are utilized in conjunction with conventional cathodes used for the electrohydrodimerization of acrylonitrile to adiponitrile. These cathodes include electrodes made from lead, cadmium, zinc, graphite, carbon steel, titanium, nickel and copper. The electrolyte systems are conventional and include such electrolytes as a $Na_2HPO_4$ based system and a sulfuric acid based system. It is also conventional to use a different electrolyte composition at the anode compartment than is used at the cathode compartment. Typically, additives such as corrosion inhibitors can be added to the electrolyte system.

Any good commercial grade of acrylonitrile is suitable for electrohydrodimerization including acrylonitrile available from Monsanto Corporation. Any oxidizable gas that is compatible with the electrohydrodimerization process is suitable as the reductant. A reductant, by definition, is that species that is oxidized at the anode. Preferred gases include hydrogen, methanol, reformed gas, and coal gasifier effluent. Reformed gas is the reaction product of hydrocarbons and steam and is typically a mixture of $CO_2$, $H_2$, CO, and water vapor. Coal gasifier effluent is the reaction product of coal steam and air or oxygen and is typically a mixture of $H_2$, CO, and $N_2$.

Conventional electrochemical cells and electrohydrodimerization processes are described in *Adiponitrile via Improved EHD,* D. E. Danly, Hydrocarbon Processing, April 1981, which is incorporated by reference. In this process the electrolyte solution is maintained in contact with both electrodes in order to complete the electrical circuit. In the adaptation of this process as disclosed in this application, fuel gas is supplied to the anode utilizing technology conventional to the fuel cell art, through gas manifolds and flow channels to each cell while acrylonitrile is supplied to the cathode by convention means, for example, circulating a fluid stream containing acrylonitrile, water, and dissolved salts to the cathode compartment of the reaction cell. It is preferred that the fuel gas and acrylonitrile are continually supplied to the respective electrodes as the electrolysis products are removed resulting in a continuous vs. a batch process. When electric currents of about 20 ma/cm$^2$ to about 250 ma/cm$^2$ are passed across the electrodes, electrolysis occurs. At the cathode acrylonitrile is hydrodimerized to adiponitrile; empirically this is illustrated as $2H_2CCHCN+2H_2O+2e^- \rightarrow NC(CH_2)_4CN+2OH^-$. At the gas depolarizing anode of this invention, a reductant, preferably hydrogen, is oxidized. For hydrogen this can be empirically illustrated as $H_2+2OH^- \rightarrow 2H_2O+2e^-$. Typical yields based on adiponitrile range between about 60% to about 90%.

EXAMPLE 0.5 milligram (mg) platinum particles were deposited on 50 mg of Vulcan XC-72 TM (Cabot Corp.) carbon black particles. This catalyzed carbon was mixed with 33.3 mg of Teflon 30 particles. This carbon catalyst mixture was applied to a conventional carbon paper electrode structure and heat treated at 590° F. for about 15 minutes to form a gas depolarizing anode. This electrode was tested in an aqueous solution comprising 10% $Na_2HPO_4$, 3.8% $Na_2B_4O_7.10H_2O$, and 0.4% ethyldibutyl ammonium phosphate. A test of the gas depolarizing electrode in a typical electrolyte solution used in a electrohydrodimerization process is sufficient to demonstrate the effectiveness of an electrohydrodimerization process that utilizes that anode, as the anode is independent of the rest of the cell. The results are incorporated in the FIGURE, curve 2.

In the FIGURE the X axis represents cell current density. This is plotted against anode voltage (y) in millivolts (mv). The anode voltage is not an absolute term, it is measured against a hydrogen electrode in the same solution which is used as a reference electrode (HRE). The voltage of the HRE is assumed to be zero. The point 1.23 volts is the theoretical voltage required to evolve oxygen from the anode. Curve 1 illustrates the actual voltage required to evolve oxygen from a carbon steel electrode in a solution of $Na_2HPO_4$, the typical electrolyte used in cells which produce adiponitrile from the electrohydromerization of acrylonitrile. The oxygen evolution data points were taken from the referenced Danly article. The difference between the curve and the 1.23 volts is the overvoltage which is defined as the excess of observed decomposition voltage of an aqueous electrolyte over the theoretical reversible decomposition voltage. In contrast to curve 1, curve 2 illustrates the voltages required for a hydrogen consuming anode in a similar electrolyte solution. For instance, at 100 ma/cm$^2$ of electrode area there is a voltage requirement of less than about 400 mv. Millivolt (mv) is defined as 0.001 volt. For the hydrogen consuming electrode the overvoltage is the difference between the HRE (X axis) and curve 2. A comparison of curve 2 and curve 1 at a specific current density clearly illustrates the lower voltages required by the hydrogen consuming electrode. Even if an oxygen evolving electrode with no overvoltage were developed, the hydrogen consuming electrode would still be superior.

These cells make a significant contribution to electrochemical technology, particularly the adiponitrile industry by incorporating energy saving gas depolarizing anodes. The power consumption for the electrohydrodimerization of acrylonitrile to adiponitrile depends on the voltages required for the anode and cathode reactions. Typical anodes used in the hydrodimerization processes require close to 2.4 volts. By contrast, the hydrodimerization processes of this invention incorporate anodes requiring voltages of close to 0.5 volts, a savings of about 1.9 volts.

These reduced voltages result in significant energy savings for electrohydrodimerization processes. Although the anodes of this invention require a fuel gas, they will work well in an adiponitrile plant since pure hydrogen is typically available for the further processing of adiponitrile. Thus electrochemical technology relating to adiponitrile production has been advanced by the discovery of processes that incorporate energy saving electrodes.

It should be understood that the invention is not limited to the particular embodiments shown and described herein, but that various changes and modifications may be made without departing from the spirit and scope of this novel concept as defined by the following claims.

I claim:

1. A method of hydrodimerizing acrylonitrile to produce adiponitrile in an electrochemical system in cells that contain at least one aqueous electrolyte, reductant, an anode and a cathode comprising:

(a) maintaining the aqueous electrolyte in contact with the cathode and a gas depolarized anode;

(b) maintaining a supply of acrylonitrile at the cathode;

(c) maintaining a supply of reductant at the anode; and (d) passing a direct electric current through said system causing hydrodimerization of the acrylonitrile to adiponitrile at the cathode and oxidation of the reductant at the anode;

requiring an anode voltage of less than about 400 millivolts at 100 milliamperes per square centimeter of electrode area.

2. The method as recited in claim 1 wherein the gas depolarizing anode comprises a mixture of binder and catalyst supported on a conductive electrode substrate.

3. The method as recited in claim 2 wherein the binder is a fluorocarbon polymer, the catalyst is a noble metal and the conductive electrode substrate is carbon paper, stainless steel, carbon steel or nickel.

4. The anode as recited in claim 2 wherein the mixture comprises about 40% polytetrafluoroethylene binder and about 5% platinum catalyst.

5. The method as recited in claim 1 wherein the reductant is selected from the group consisting of hydrogen gas, reformed gas, methanol, and coal gasifier effluent.

* * * * *